US005435522A

United States Patent [19]

Brosius

[11] Patent Number: 5,435,522

[45] Date of Patent: Jul. 25, 1995

[54] VEHICLE LIFT

[75] Inventor: Peter Brosius, Ayl, Germany

[73] Assignee: August Bilstein GmbH & Co. KG, Ennepetal, Germany

[21] Appl. No.: 393,949

[22] Filed: Feb. 22, 1995

Related U.S. Application Data

[63] Continuation of Ser. No. 221,702, Apr. 1, 1994, abandoned.

[30] Foreign Application Priority Data

Apr. 30, 1993 [DE] Germany ..... 43 14 136.6

[51] Int. Cl.[6] ..... B66F 3/12

[52] U.S. Cl. ..... 254/126; 254/DIG. 1

[58] Field of Search ..... 254/126, 124, 100, 101, 254/DIG. 1

[56] References Cited

U.S. PATENT DOCUMENTS

| | | | |
|---|---|---|---|
| 3,989,225 | 11/1976 | Keilholz | 254/126 |
| 4,093,182 | 6/1978 | Rutenbeck | 254/126 |
| 5,011,118 | 4/1991 | Brosius | 254/126 |
| 5,275,378 | 1/1994 | Alten | 254/126 |

*Primary Examiner*—Robert C. Watson
*Attorney, Agent, or Firm*—Max Fogiel

[57] ABSTRACT

Jack with an upright (1) that rests on a base (8 or 19). An arm (3) that pivots around a horizontal axis (r) on the upright. The arm has a load accommodation (4) on its free end and engaging the bottom of the vehicle. The arm can be pivoted to various levels directly or by way of levers and transmissions attached to it and to the upright by a manually controlled mechanism, specifically a threaded shaft (5). A brace (15) is attached to the upright and rests flat against the ground or floor (11) at the end of the base facing away from the vehicle while the jack is in the initial-introduction position. The brace is a tab rigidly attached to the upright (1).

4 Claims, 2 Drawing Sheets

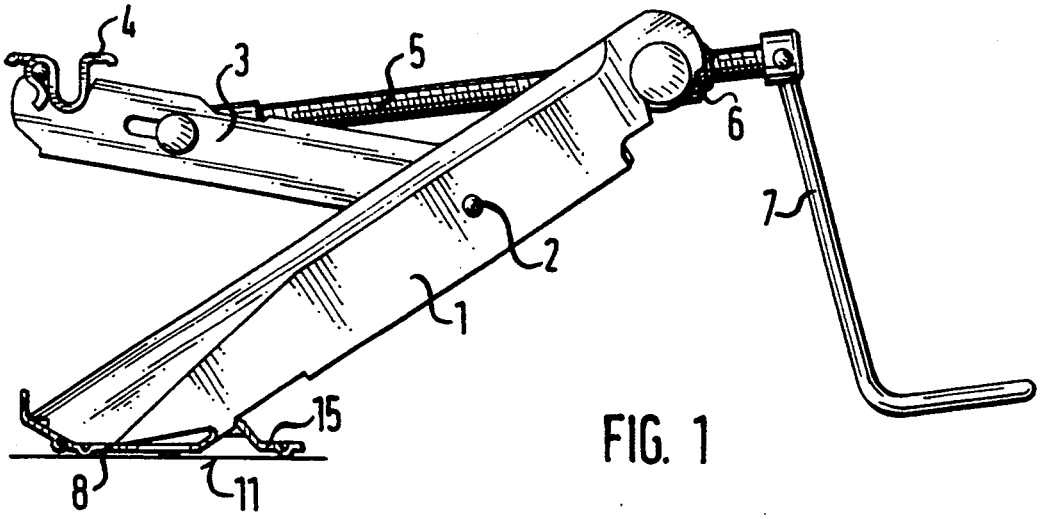
FIG. 1
FIG. 2
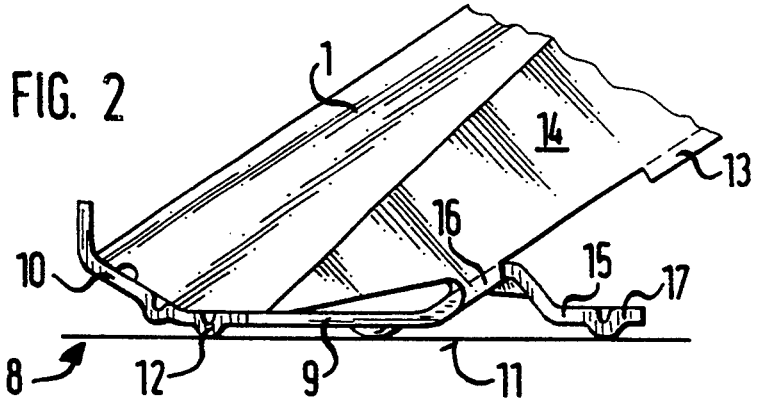

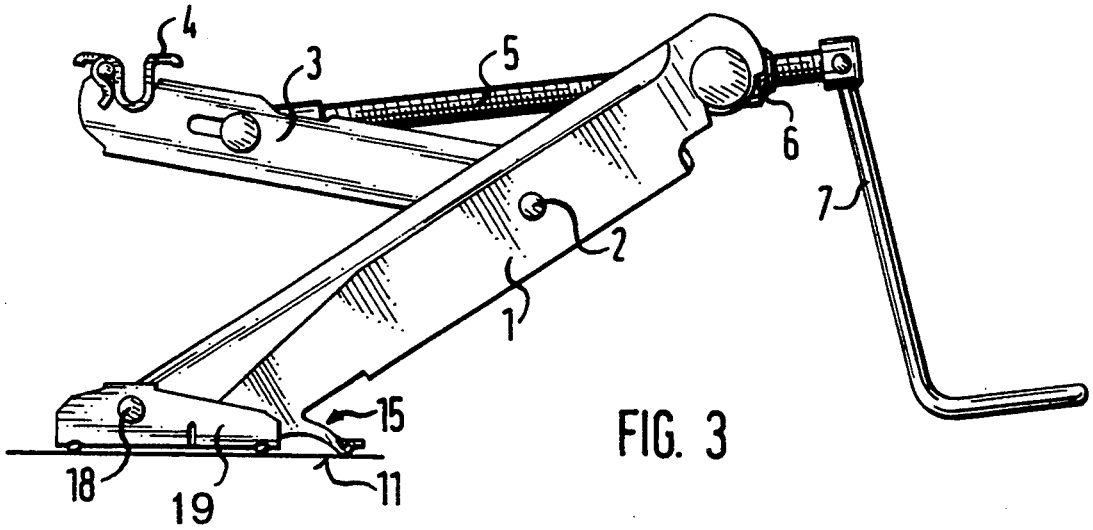
FIG. 3
FIG. 4
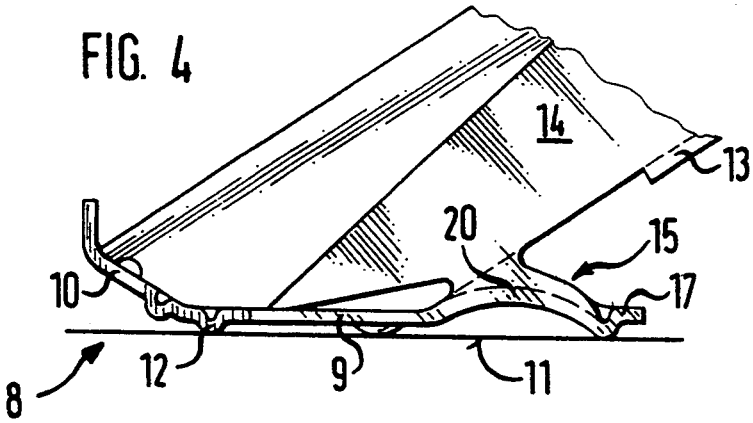

VEHICLE LIFT

The present application is a continuation of the parent application Ser. No. 221,702 filed Apr. 1, 1994, now abandoned.

BACKGROUND OF THE INVENTION

The present invention concerns a jack with an extra brace on its upright. Jacks that have a rolling base rigidly attached to the upright must in particular be initially introduced as flat against the ground or floor as possible. The jack's center of gravity will in that event be far remote from the vehicle. To prevent the jack illustrated in FIG. 4 of German 2 427 443 A1 from tilting out of the initial-introduction position, it has a folding U-shaped brace on its upright. The alternative illustrated in FIG. 1 of the same publication is bent, and the one illustrated in FIG. 3 has a roller base with a long initial-introduction leg.

These jacks all have drawbacks. They are heavy and accordingly increase the weight of the vehicle itself.

SUMMARY OF THE INVENTION

The object of the present invention is to improve a jack of the aforesaid genus in that it will weigh little or no more than a conventional jack.

An additional advantage turns out to be that the jack is also easier to manufacture in that no additional component in the form of a brace needs to be mounted on the upright.

BRIEF DESCRIPTION OF THE DRAWINGS

One embodiment of the invention will now be described with reference to the drawing, wherein FIG. 1 is a view of a jack with a roller base, FIG. 2 is a larger-scale detail of the vicinity of the base, FIG. 3 illustrates a version with a pivoting base, and FIG. 4 illustrates a different type of brace.

DESCRIPTION OF THE PREFERRED EMBODIMENTS

An articulated jack has an upright 1. A supporting arm 3 pivots around a horizontal axis 2 on upright 1. On the free end of arm 3 is a load accommodation 4. Load accommodation 4 engages the bottom of the vehicle, preferably the sill. Arm 3 and upright 1 are connected by a threaded shaft 5. Shaft 5 operates in conjunction with a traveling nut 6. Shaft 5 can be turned by a crank 7 on its free end, which raises arm 3 on upright 1 and lifts the load in accommodation 4. Both upright 1 and arm 3 are lengths of essentially U-shaped metal structural section with a base 13 and two sides 14.

Secured to the bottom of upright 1 is a base. The base 8 of the embodiment illustrated in FIG. 1 has rollers. FIG. 2 is a larger-scale detail of the bottom of upright 1 with base 8 and its rollers. Base 8 is also manufactured from structural section in two ground-or-floor contact surfaces 9 and 10. The jack is illustrated in FIGS. 1 and 2 in its initial-introduction position, before the vehicle has been lifted. Contact surface 9 is resting flat against ground or floor 11. Upright 1 swings erect as the vehicle rises and tilts toward the left in the figure around outward fold 12 until contact surface 10 comes to rest flat against the ground. The jack will now have lifted the load as far as it can. Adjoining the end of the jack's base 8 facing away from the vehicle is a brace 15. Brace 15 consists of a metal tab stamped U-shaped out of the base 13 of the section comprising upright 1. The tab comprising brace 15 extends continuously into the bottom 16 of base 13. Since nothing has been stamped out at this point, brace 15 is integrated into bottom 16. The free end 17 of brace 15 rests like contact surface 9 flat against ground or floor 11 while the jack is in the initial-introduction position.

The base 19 of the jack illustrated in FIG. 3 pivots around an axis 18 at the bottom of upright 1. Base 19 will accordingly remain resting entirely in contact with ground or floor 11 while upright 1 straightens up, lifting the vehicle. It can make sense to attach a brace 15 to the end of base 19 that faces away from the vehicle in this embodiment as well. Such a brace will help to brace the jack against the ground or floor while it is being initially introduced. This brace is designed and attached to the upright like the brace specified with reference to FIGS. 1 and 2.

Part of the brace 15 illustrated in FIG. 4 is made of structural section like that of upright 1. Its stability is increased by lateral flanges 20.

LIST OF PARTS

1. upright
2. axis
3. arm
4. load accommodation
5. threaded shaft
6. traveling nut
7. crank
8. roller base
9. contact surface
10. contact surface
11. ground or floor
12. outward fold
13. base of U section
14. sides of U section
15. brace
16. bottom of jack
17. free end
18. pivot
19. pivoting brace
20. flange

I claim:

1. A jack for a vehicle comprising: a base; an upright leg resting on said base and having a U-shaped cross-section; a carrying arm pivotable about a horizontal axis on said upright leg and having a free end; a load head on said free end of said carrying arm and engaging the bottom of the vehicle; manually controlled means in the form of a threaded shaft for pivoting said arm through transmission means connected to said arm and to said upright leg; a brace attached to said upright leg and resting against the ground at an end of said base facing away from the vehicle when said jack is in an initial position, said brace comprising a sheet metal tab stamped out of said base and cut off at three sides and remaining connected at one side with said upright leg adjacent said base.

2. A jack as defined in claim 1, wherein said brace comprises further a structural shape.

3. A jack for a vehicle comprising: a base; an upright leg resting on said base and having a U-shaped cross-section; a carrying arm pivotable about a horizontal axis on said upright leg and having a free end; a load head on said free end of said carrying arm and engaging the bottom of the vehicle; manually controlled means in the form of a threaded shaft for pivoting said arm through transmission means connected to said arm and to said upright leg; a brace attached to said upright leg and resting against the ground at an end of said base facing away from the vehicle when said jack is in an initial position, said brace comprising a sheet metal tab stamped out and cut off at three sides out of said base and adjacent regions of said upright leg and remaining connected at one side with said upright leg adjacent said base.

4. A jack as defined in claim 3, wherein said brace comprises further a structural shape.

* * * * *